US012692578B2

(12) United States Patent
Kaner et al.

(10) Patent No.: US 12,692,578 B2
(45) **Date of Patent: *Jul. 28, 2026**

(54) COMPOSITIONAL VARIATIONS OF TUNGSTEN TETRABORIDE WITH TRANSITION METALS AND LIGHT ELEMENTS

(71) Applicant: The Regents of the University of California, Oakland, CA (US)

(72) Inventors: Richard B. Kaner, Pacific Palisades, CA (US); Sarah H. Tobert, Encino, CA (US); Reza Mohammadi, Los Angeles, CA (US); Andrew T. Lech, Los Angeles, CA (US); Miao Xie, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 222 days.

This patent is subject to a terminal disclaimer.

(21) Appl. No.: 18/525,418

(22) Filed: Nov. 30, 2023

(65) Prior Publication Data

US 2024/0191327 A1 Jun. 13, 2024

Related U.S. Application Data

(63) Continuation of application No. 16/912,396, filed on Jun. 25, 2020, now Pat. No. 11,873,544, which is a (Continued)

(51) Int. Cl.
*C22C 27/04* (2006.01)
*B22F 5/00* (2006.01)

(Continued)

(52) U.S. Cl.
CPC ..... *C22C 27/04* (2013.01); *B22F 9/04* (2013.01); *C22C 1/02* (2013.01); *C22C 29/14* (2013.01);

(Continued)

(58) Field of Classification Search
None
See application file for complete search history.

(56) References Cited

U.S. PATENT DOCUMENTS 3,507,632 A 4/1970 Swoboda
3,535,110 A 10/1970 Hoyt et al.

(Continued)

OTHER PUBLICATIONS

International Search Report and Written Opinion of PCT/US2012/034685, mailed Nov. 13, 2014.

(Continued)

*Primary Examiner* — Colin W. Slifka
(74) *Attorney, Agent, or Firm* — Venable LLP; Ryan T. Ward

(57) ABSTRACT

A composition includes tungsten (W); at least one element selected form the group of elements consisting of boron (B), beryllium (Be) and silicon (Si); and at least one element selected from the group of elements consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li) and aluminum (Al). The composition satisfies the formula $W_{1-x}M_xX_y$ wherein X is one of B, Be and Si; M is at least one of Ti, V, Cr, Mn, Fe, Co, Ni, Cu, Zn, Zr, Nb, Mo, Ru, Hf, Ta, Re, Os, Ir, Li and Al; x is at least 0.001 and less than 0.999; and y is at least 4.0. A tool is made from or coated with this composition.

20 Claims, 12 Drawing Sheets

Related U.S. Application Data continuation of application No. 16/142,607, filed on Sep. 26, 2018, now Pat. No. 10,731,236, which is a continuation of application No. 14/112,903, filed as application No. PCT/US2012/034685 on Apr. 23, 2012, now Pat. No. 10,125,412.

(60) Provisional application No. 61/478,276, filed on Apr. 22, 2011.

(51) Int. Cl.

| | |
|---|---|
| ***B22F 9/04*** | (2006.01) |
| ***C22C 1/02*** | (2006.01) |
| ***C22C 29/14*** | (2006.01) |
| ***C23C 30/00*** | (2006.01) |

(52) U.S. Cl.

CPC ..... *C23C 30/00* (2013.01); *C23C 30/005* (2013.01); *B22F 2005/001* (2013.01); *B22F 2009/041* (2013.01)

(56) References Cited

U.S. PATENT DOCUMENTS

| | | | | |
|---|---|---|---|---|
| 3,668,017 | A | 6/1972 | Mandineau et al. | |
| 3,773,903 | A | 11/1973 | Kuratomi | |
| 4,019,873 | A | 4/1977 | Reiter | |
| 4,365,997 | A | 12/1982 | Jachowski et al. | |
| 5,178,647 | A | 1/1993 | Komatsu et al. | |
| 5,966,585 | A | 10/1999 | Sue | |
| 6,106,957 | A | 8/2000 | Fang | |
| 6,830,738 | B1 | 12/2004 | Lupinetti et al. | |
| 10,125,412 | B2 * | 11/2018 | Kaner | C22C 1/045 |
| 10,731,236 | B2 * | 8/2020 | Kaner | C23C 30/005 |
| 11,174,538 | B2 * | 11/2021 | Kaner | C22C 29/08 |
| 2002/0025906 | A1 | 2/2002 | Hagiya et al. | |
| 2002/0054794 | A1 | 5/2002 | Kato et al. | |
| 2002/0088508 | A1 | 7/2002 | Holzl et al. | |
| 2003/0054940 | A1 | 3/2003 | Abe et al. | |
| 2008/0125323 | A1 | 5/2008 | Nepela | |
| 2011/0262295 | A1 | 10/2011 | Voronov et al. | |
| 2020/0325561 | A1 * | 10/2020 | Kaner | C23C 30/005 |

OTHER PUBLICATIONS

R. Mohammadi et al., "Ambient-pressure synthesis and characterization of superhard intermetallic and solid-solution borides", American Chemical Society (ACS) Spring Meeting, Anaheim, CA, USA, Mar. 27-31, USA.

L. G. Bodrova et al., "Theory, Production Technology, and Properties of Powders and Fibers", Soviet Powder Metallurgy and Metal Ceramics, vol. 13, Jan. 1, 1974, pp. 1-3, XP055138580.

Q. Gu et al., "Transition Metal Borides: Superhard versus Ultra-incompressible", Advanced Materials, vol. 20, No. 19, Oct. 2, 2008, pp. 3620-3626, XP055138946.

* cited by examiner

COMPOSITIONAL VARIATIONS OF TUNGSTEN TETRABORIDE WITH TRANSITION METALS AND LIGHT ELEMENTS

CROSS-REFERENCE OF RELATED APPLICATION

This application is a continuation of U.S. patent application Ser. No. 16/912,396, filed Jun. 25, 2020, now U.S. Pat. No. 11,873,544, which is a continuation of U.S. patent application Ser. No. 16/142,607, filed Sep. 26 2018, now U.S. Pat. No. 10,731,236, which is a continuation of U.S. patent application Ser. No. 14/112,903, filed Oct. 18, 2013, now U.S. Pat. No. 10,125,412, which is a national stage application under 35 U.S.C. § 371 of PCT/US2012/034685 filed Apr. 23, 2012, the entire contents of which are incorporated herein by reference and this application claims priority to U.S. Provisional Application No. 61/478,276 filed Apr. 22, 2011, the entire contents of which are hereby incorporated by reference.

This invention was made with U.S. Government support under Grant Nos. 0805357 and 1106364 awarded by the National Science Foundation. The U.S. Government has certain rights in this invention.

BACKGROUND

1. Field of Invention

The field of the currently claimed embodiments of this invention relates to compositions of matter and articles of manufacture that use the compositions, and more particularly to compositional variations of tungsten tetraboride and articles of manufacture that use the compositional variations of tungsten boride.

2. Discussion of Related Art

In many manufacturing processes, materials must be cut, formed, or drilled and their surfaces protected with wear-resistant coatings. Diamond has traditionally been the material of choice for these applications, due to its superior mechanical properties, e.g. hardness>70 GPa (1, 2). However, diamond is rare in nature and difficult to synthesize artificially due to the need for a combination of high temperature and high pressure conditions. Industrial applications of diamond are thus generally limited by cost. Moreover, diamond is not a good option for high-speed cutting of ferrous alloys due to its graphitization on the material's surface and formation of brittle carbides, which leads to poor cutting performance (3). Other hard or superhard (hardness≥40 GPa) substitutes for diamond include compounds of light elements such as cubic boron nitride (4) and $BC_2N$ (5) or transition metals combined with light elements such as WC (6), HfN (7) and TiN (8). Although the compounds of the first group (C, B or N) possess high hardness, their synthesis requires high pressure and high temperature and is thus non-trivial (9, 10). On the other hand, most of the compounds of the second group (transition metal-light elements) are not superhard although their synthesis is more straightforward.

To overcome the shortcomings of diamond and its substitutes, we have been pursuing the synthesis of dense transition metal borides, which combine high hardness with synthetic conditions that do not require high pressure (11, 12). For example, arc melting and metathesis reactions have been used to synthesize the transition metal diborides $OsB_2$ (13, 14), $RuB_2$ (15) and $ReB_2$ (16-20). Among these, rhenium diboride ($ReB_2$) with a hardness of ~48 GPa under a load of 0.49 N has proven to be the hardest (16, 21). The boron atoms are needed to build the strong covalent metal-boron and boron-boron bonds that are responsible for the high hardness of these materials (12). Because of this, it is expected that by increasing the concentration of boron in these types of lattices, the hardness could increase. Most transition metals, however, form compounds with low boron content. Tungsten is one of the few transition metals that is known for its ability to form higher boron content borides. In addition to tungsten diboride ($WB_2$), which is not superhard (22, 23), tungsten is able to form tungsten tetraboride ($WB_4$), the highest boride of tungsten that exists under equilibrium conditions (24-26). Advantages of this material over other borides are: i) both tungsten and boron are relatively inexpensive, ii) the lower metal content in the higher borides reduces the overall cost of production since the more costly transition metal is being replaced by less expensive boron thus reducing the cost per unit volume and iii) the higher boron content lowers the overall density of the structure, which could be beneficial in applications where lighter weight is an asset.

Tungsten tetraboride was originally synthesized in 1966 (24) and its structure assigned to a hexagonal lattice (space group: $P6_3/mmc$). The possibility of high hardness in this material was first suggested by Brazhkin et al. (27) and we discussed its potential applications as a superhard material in a Science Perspective in 2005 (12). Recently, Giu et al (28) reported hardness values of 46 and 31.8 GPa under applied loads of 0.49 and 4.9 N, respectively, and a bulk modulus of 200-304 GPa without giving any synthetic details or even presenting an X-ray diffraction pattern. Since superhard materials have shown a large load-dependant hardness (13, 16), commonly referred to as the "indentation size effect", reporting a single hardness value for these materials is insufficient and suggests that a more detailed study is needed. Therefore, here we examine the hardness of tungsten tetraboride using micro- and nano-indentation, Furthermore, with a valence electron density of 0,485 e-$Å^3$ (11), which is comparable to that of $ReB_2$ (0.477 $e^- Å^{-3}$), the bulk modulus of 200-304 GPa reported by Gu et al. for tis material seems low compared to other superhard transition metal borides such as $ReB_2$, with a bulk modulus of 360 GPa (16), and therefore requires further investigation. Since the purity of superhard materials directly influences their mechanical properties (29), the existence of other borides of tungsten in the samples might explain the anomalously low bulk modulus, Making solid ingots of phase pure $WB_4$ is especially challenging since the tungsten-boron phase diagram indicates that $WB_2$ is thermodynamically favorable with any W:B molar ratio below 1:12 (24). There thus remains a need for improved hard materials and articles that use the improved materials.

SUMMARY

A composition according to some embodiments of the current invention includes tungsten (W); at least one element selected form the group of elements consisting of boron (B), beryllium (Be) and silicon (Si); and at least one element selected from the group of elements consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li) and aluminum (Al). The composition satisfies the formula $$W_{1-x}M_xX_y$$

wherein X is one of B, Be and Si; M is at least one of Ti, V, Cr, Mn, Fe, Co, Ni, Cu, Zn, Zr, Nb, Mo, Ru, Hf, Ta, Re, Os, Ir, Li and Al; x is at least 0.001 and less than 0.999; and y is at least 4.0.

A tool according to some embodiments of the current invention includes a surface for cutting or abrading. The surface is a surface of a composition of matter that includes tungsten (W); at least one element selected form the group of elements consisting of boron (B), beryllium (Be) and silicon (Si); and at least one element selected from the group of elements consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li) and aluminum (Al). The composition satisfies the formula $$W_{1-x}M_xX_y$$

wherein X is one of B, Be and Si; M is at least one of Ti, V, Cr, Mn, Fe, Co, Ni, Cu, Zn, Zr, Nb, Mo, Ru, Hf, Ta, Re, Os, Ir, Li and Al; x is at least 0.001 and less than 0.999; and y is at least 4.0.

BRIEF DESCRIPTION OF THE DRAWINGS

Further objectives and advantages will become apparent from a consideration of the description, drawings, and examples.

DETAILED DESCRIPTION

Figure 1:
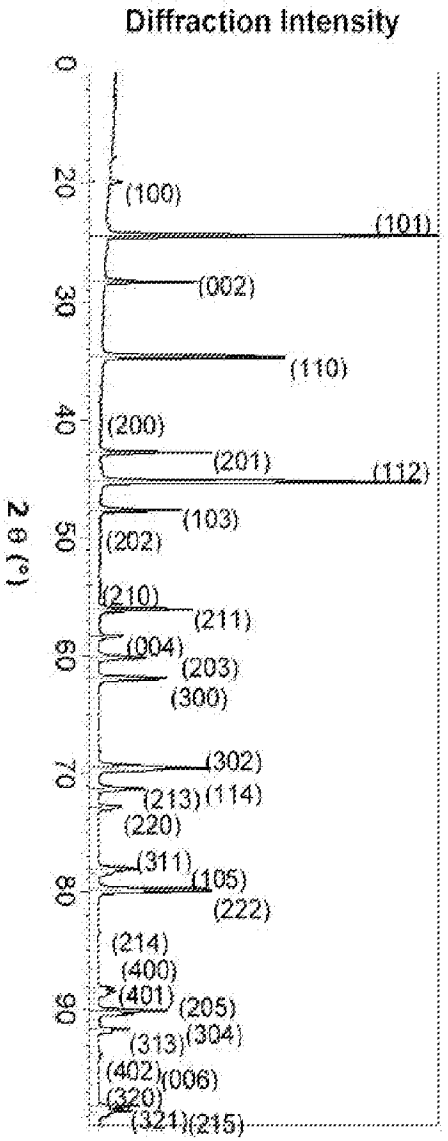
FIG. 1 shows an X-ray diffraction pattern of tungsten tetraboride ($WB_4$) synthesized via arc melting. The stick pattern given below is from the Joint Committee on Powder Diffraction Standards (JCPDS, Ref. Code: 00-019-1373) for $WB_4$. The corresponding Miller Index is given above each peak.

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections, are incorporated by reference as if each had been individually incorporated.

Some embodiments of this invention are related to the hardness improvement of tungsten tetraboride ($WB_4$) by substituting various concentrations (partial or complete) of tungsten and/or boron with transition metals and light elements, respectively. The increase of hardness, due to solid solution, grain boundary dispersion and precipitation hardening mechanisms can lead to the production of machine tools with enhanced life time according to some embodiments of the current invention. The developed materials, both in bulk and thin film conditions, can be used in a variety of applications including drill bits, saw blades, lathe inserts and extrusion dies as well as punches for cup, tube and wire drawing processes according to some embodiments of the current invention.

The existing state-of-the-art in the area of transition metal-borides includes the solid-state synthesis and characterization of osmium and ruthenium diboride compounds (Kaner et al., U.S. Pat. No. 7,645,308; Cumberland et al., J. Am. Chem. Soc., 2005, 127, 7264-7265; Weinberger et al., Mater., 2009, 21, 1915-1921), rhenium diboride (Chung et al., Science, 2007, 316, 436-439; Levine et al., J. Am. Chem. Soc., 2008, 130, 16953-16958) and tungsten diboride (Munro, J. Res. Natl. Inst. Stan., 2000, 105, 709-720). The concept of high hardness of tungsten tetraboride ($WB_4$), which contains more boron-boron bonds compared to aforementioned superhard diborides, was first introduced by Brazhkin et al. (Philos. Mag. A, 2002, 82, 231-253) and its application as a superhard material was discussed in our Science Perspective in 2005 (Kaner et al., Science, 2005, 308, 1268-1269). While several attempts have been made to synthesize the phase pure of this superhard material (Gu et al., Adv. Mater., 2008, 20, 3620-3626), there have been no reports, to our knowledge, on improving the hardness of this inexpensive superhard material.

We have been successful in developing new superhard materials based on tungsten tetraboride by replacing tungsten with other transition metals such as rhenium according to some embodiments of the current invention. In addition to being inexpensive and possessing metallic conductivity, the developed materials exhibit improved Vickers hardness to well above 50 GPa, which is by far higher than the hardness of $WB_4$ (~43 GPa).

Compositional variations of $WB_4$ can be synthesized by replacing W with other metals (such as Ti, V, Cr, Mn, Fe, Co, Ni, Cu, Zn, Zr, Nb, Mo, Ru, Hf, Ta, Re, Os, Ir, Li and Al) and/or B with light elements (such as Be and Si) according to some embodiments of the current invention. Pure powders of these elements, with a desired stoichiometry, are ground together using an agate mortar and pestle until a uniform mixture is achieved. In the case of $WB_4$ compounds, a tungsten to boron ratio of 1:12 should be used. The excess boron is needed to compensate for its evaporation during synthesis and to ensure the thermodynamic stability of the $WB_4$ structure based on the binary phase diagram of the tungsten-boron system. Each mixture is pressed into a pellet by means of a hydraulic (Carver) press. The pellets are then placed in an arc melting furnace and an AC/DC current of >60 Amps is applied under high-purity argon at ambient pressure. Other synthesis techniques including hot press and spark plasma sintering can also be used. To make thin films of these materials, various deposition techniques such as sputtering, pack cementation, etc. can be used.

The implementation of these compounds in practice can require some minor technical adjustments and their adaptation to industrial scale. For example, using powerful presses to press big pellets and big arc melting furnaces to arc large pellets is needed for some applications. In the case of using sintering methods to synthesize the specimens, appropriate large-scale hot press or SPS machines and well-designed dies for the specific geometries of the products (inserts, drill bits, dies, etc.) may be required. Since most of these compounds are electrically conductive, to minimize the production time electro discharge machines (EDMs) can also be very beneficial for cutting, drilling, finishing and other post-synthesis processes necessary for the fabrication of the products made of these superhard materials according to some embodiments of the current invention. To add ductility to the products, adding Co, Ni, or Cu or a combination of these three elements can be useful. For thin film applications of these materials, hi-tech thin film deposition systems may be needed.

Figure 9:
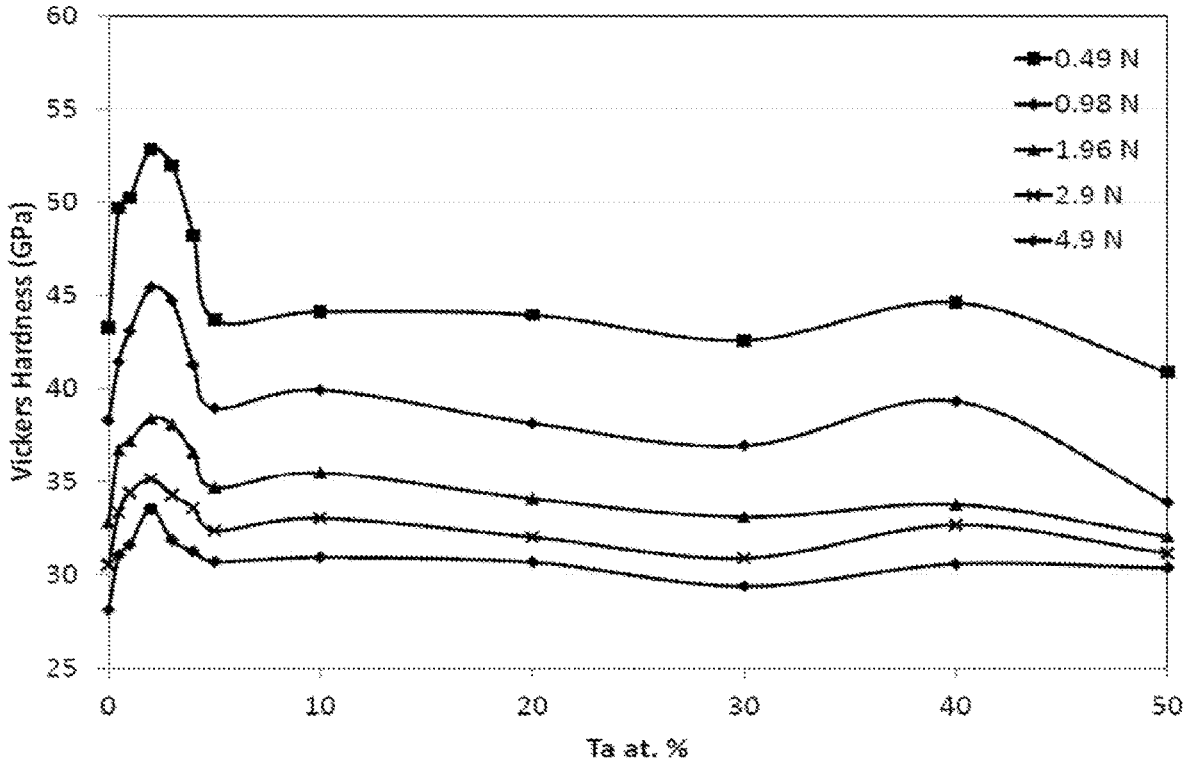
FIG. 9 shows micro-indentation hardness data for tungsten/rhenium boride samples as a function of tantalum content. Data were collected for samples with Ta additions of 0.0, 0.5, 1.0, 2.0, 3.0, 4.0, 5.0, 10.0, 20.0, 30.0, 40.0 and 50.0 at. %. The low-load hardness increases from 43.3 GPa for $WB_4$ to a maximum of ~52 GPa at 2 at. % Ta, decreases to a minimum of 44 GPa at 5 at. % Ta and then increases again up to 46 GPa at 40 at. % Ta. Similar trends are observed for all of the loads (0.49 N-4.9 N).
Figure 10:
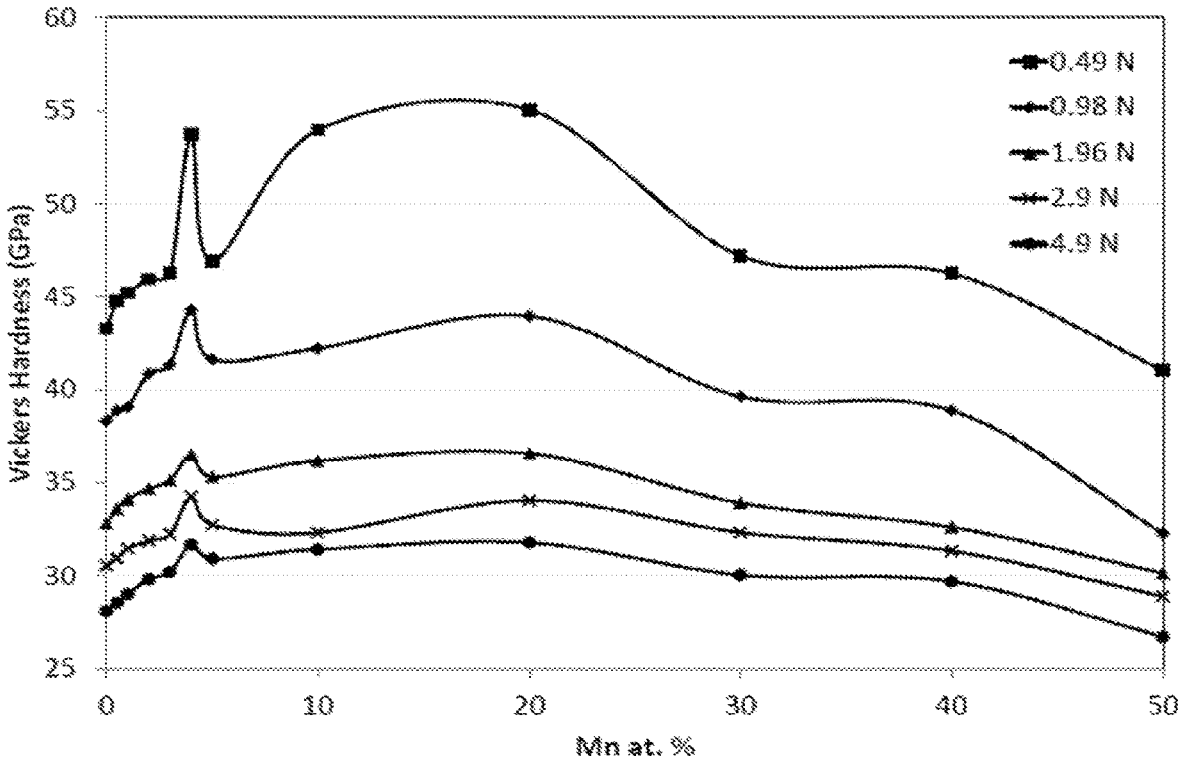
FIG. 10 shows micro-indentation hardness data for tungsten/rhenium boride samples as a function of manganese content. Data were collected for samples with Mn additions of 0.0, 0.5, 1.0, 2.0, 3.0, 4.0, 5.0, 10.0, 20.0, 30.0, 40.0 and 50.0 at. %. The low-load hardness increases from 43.3 GPa for $WB_4$ to a maximum of ~53 GPa at 4 at. % Mn, decreases to a minimum of 47 GPa at 5 at. % Mn and then increases again up to ~55 GPa at 20 at. % Mn. Similar trends are observed for all of the loads (0.49 N-4.9 N).
Figure 11:
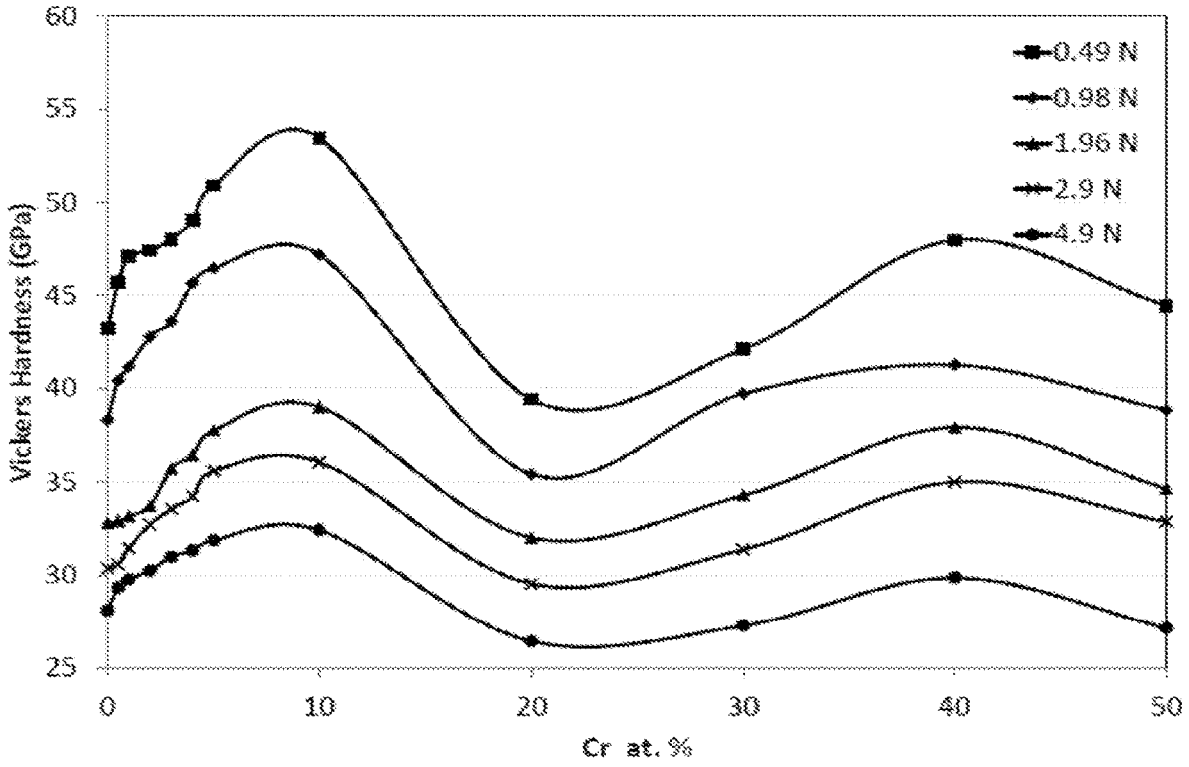
FIG. 11 shows micro-indentation hardness data for tungsten/rhenium boride samples as a function of chromium content. Data were collected for samples with Cr additions of 0.0, 0.5, 1.0, 2.0, 3.0, 4.0, 5.0, 10.0, 20.0, 30.0, 40.0 and 50.0 at. %. The low-load hardness increases from 43.3 GPa for $WB_4$ to a maximum of ~53 GPa at 10 at. % Cr, decreases to a minimum of 40 GPa at 20 at. % Cr and then increases again up to 48 GPa at 40 at. % Cr. Similar trends are observed for all of the loads (0.49 N-4.9 N).

In some examples, we have successfully synthesized and characterized various concentrations of Re in $WB_4$, i.e. $W_{1-x}Re_xB_4$ (x=0.005-0.5). Our experiments show that substitution of 1 at. % W with Re increases the Vickers hardness of $WB_4$ from ~43 GPa to ~50 GPa under an applied load of 0.49 N. This compound is thermally stable in air up to 400° C. We have also synthesized various stoichiometries of $WB_4$ with Ta, Mo, Mn and Cr, the observed hardness results of some of the compounds of which are well above 50 GPa. For example, we have measured Vickers hardness values (under an applied load of 0.49 N) of 52.8, 53.7 and 53.5 GPa when ~2.0, 4.0 and 10.0 at. % of W in $WB_4$ are replaced with Ta, Mn and Cr, respectively (FIGS. 9-11). Also, by taking advantage of these results, we have synthesized ternary/quaternary solid solutions of $WB_4$ with combinations of these three elements by keeping the concentration of Ta in $WB_4$ fixed at 2.0 at. % while varying those of Mn and Cr from 2.0 to 10.0 at. %. This led to hardness (at 0.49 N) values as high as 55.8 and 57.3 GPa for the combinations $W_{0.94}Ta_{0.02}Mn_{0.04}B_4$ and $W_{0.93}Ta_{0.02}Cr_{0.05}B_4$, respectively. We have demonstrated that $WB_4$ can be easily cut using an EDM machine, due to its superior electrical conductivity. The cut sample by EDM can be used to test the machining performance of our materials. The ductility of these compounds may be improved by adding Co, Ni or Cu to them.

More generally, a composition according to an embodiment of the current invention includes tungsten (W); at least one element selected from the group of elements consisting of boron (B), beryllium (Be) and silicon (Si); and at least one element selected from the group of elements consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li) and aluminum (Al). The composition satisfies the formula $$W_{1-x}M_xX_y$$

wherein X is one of B, Be and Si; M is at least one of Ti, V, Cr, Mn, Fe, Co, Ni, Cu, Zn, Zr, Nb, Mo, Ru, Hf, Ta, Re, Os, Ir, Li and Al; x is at least 0.001 and less than 0.999, and y has a value of at least 4.0. In some embodiments, X is B. In further embodiments, M can be two or more of the above listed elements such that the combined fraction of the two or more elements relative to W is x. In some embodiments, M is one of Re, Ta, Mn, Cr, Ta and Mn, or Ta and Cr. In further embodiments, X is B and M is one of Re, Ta, Mn, Cr, Ta and Mn, or Ta and Cr In some embodiments, x is at least 0.001 and less than 0.6. In some embodiments, X is B, M is Re, and x is at least 0.001 and less than 0.1. In further embodiments, X is B, M is Re, and x is about 0.01. The term "about" means to within ±10%. In further embodiments, M is one of Re, Ta, Mn, Cr, Ta and Mn, or Ta and Cr. In further embodiments, X is B and M is one of Re, Ta, Mn, Cr, Ta and Mn, or Ta and Cr. In further embodiments, X is B, M is Ta, and x is at least 0.001 and less than 0.05, or x is about 0.02. In further embodiments, X is B, M is Mn, and x is at least 0.001 and less than 0.4. In further embodiments, X is B, M is Cr, and x is at least 0.001 and less than 0.6.

In some embodiments, the composition consists essentially of W, Re and B, and x is at least 0.001 and less than 0.1. In further embodiments, the composition consists essentially of W, Re and B, and x is about 0.01.

Tools according to some embodiments of the current invention can have at least a cutting or abrading surface made from any of the compositions according to embodiments of the current invention. For example, a tool can have a film or coating of the above-noted compositions according to embodiments of the current invention. In other embodiments, a tool can be made from and/or include a component made from the above-noted compositions according to embodiments of the current invention. For example, drill bits, blades, dies, etc. can be either coated or made from the above-noted materials according to embodiments of the current invention. However, tools and tool components are not limited to these examples. In other embodiments, a powder or granular form of the above-noted materials can be provided either alone or attached to a backing structure to provide an abrading function. The compositions according to the current invention can be used in applications to replace currently used hard materials, such as tungsten carbide, for example. In some embodiments, the above-noted materials can be used as a protective surface coating to provide wear resistance and resistance to abrasion or other damage, for example.

The following examples are provided to help explain further concepts and details of some embodiments of the current invention. Some particular applications are also described. However, the general concepts of the current invention are not limited to the particular applications and examples.

EXAMPLES

FIG. 1 displays the X-ray diffraction (XRD) pattern of a tungsten tetraboride ($WB_4$) sample synthesized by arc melting. The XRD pattern matches very well with the reference data available for this material in the Joint Committee on Powder Diffraction Standards (JCPDS) database (24). The $WB_4$ pattern clearly shows that no impurity phases, such as tungsten diboride ($WB_2$ with major peaks at $2\theta$=25.683°, 34.680° and 35.275°), are present. The purity was confirmed using energy-dispersive X-ray spectroscopy (EDX). The sample does, however, contain some amorphous boron, which cannot be observed using XRD.

Figure 2:
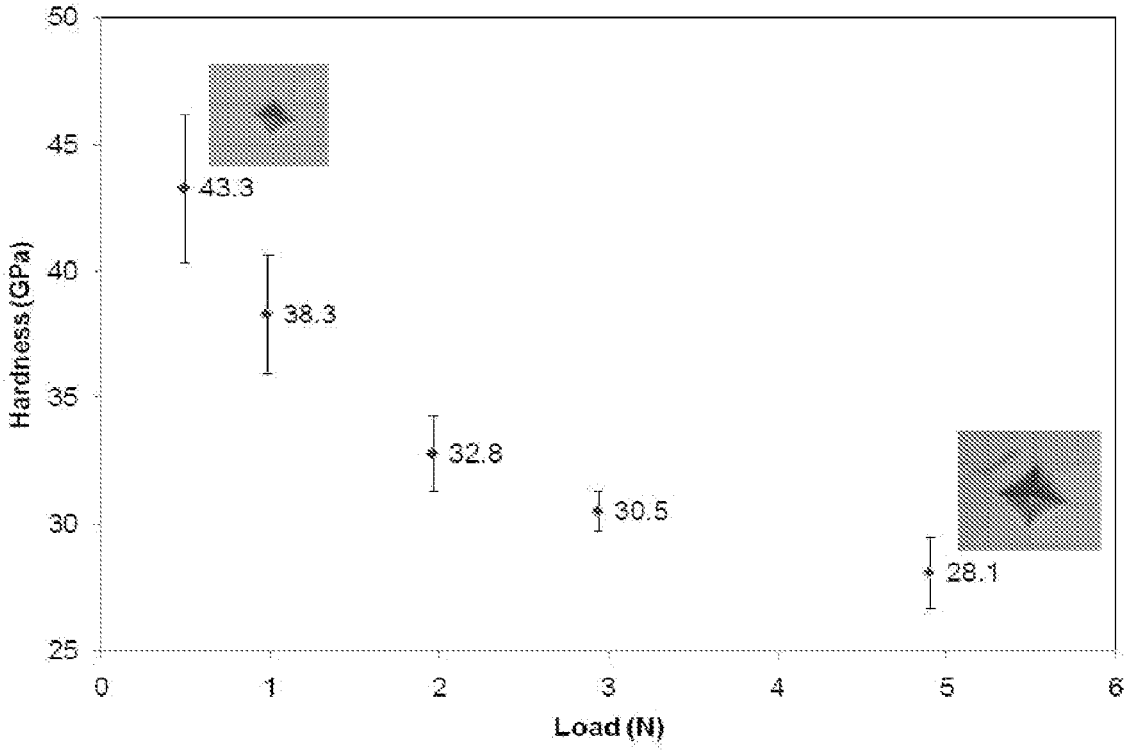
FIG. 2 provides measured Vickers micro-indentation hardness of tungsten tetraboride under loads ranging from 0.49 N (low load) to 4.9 N (high load). The corresponding hardness values range from 43.3 GPa to 28.1 GPa at low and high loads, respectively, indicating a clear indentation size effect (ISE). Typical optical images of the impressions made at high and low loads are shown.
Figure 3:
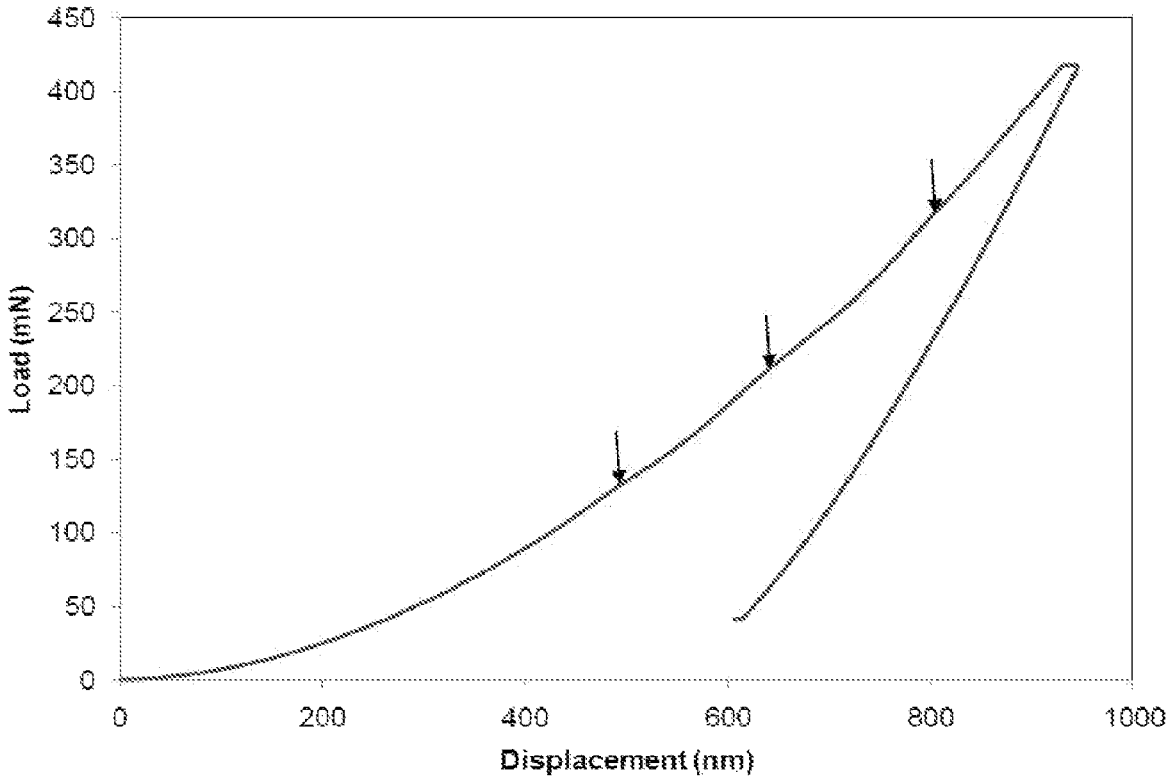
FIG. 3 shows a typical load-displacement plot obtained from nano-indentation on a tungsten tetraboride ingot. From the loading and unloading curves, nano-indentation hardness values of 40.4 GPa and 36.1 GPa are calculated at indentation depths of 250 nm and 1000 nm, respectively. The corresponding Young's modulus is ~553 GPa. The depth of penetration of the indenter is 1000 nm. The arrows show the locations of small pop-in events that may be due to a burst of dislocations, cracking or elastic-plastic deformation transitions.
Figure 4:
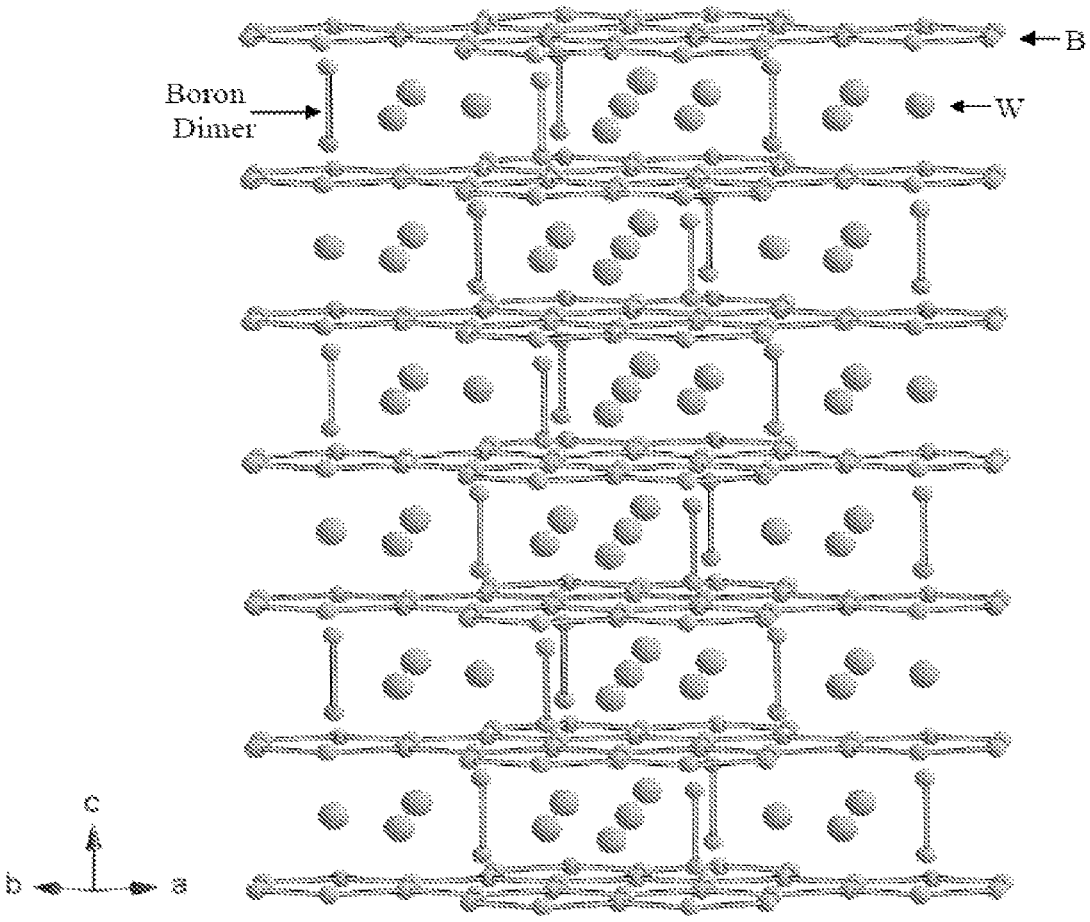
FIG. 4 is a schematic illustration of the crystal structure of tungsten tetraboride with boron bonds shown as a guide. The top layer consists of boron hexagonal planes repeated alternatively. The structure can be viewed as alternating boron and tungsten layers cemented together with boron dimer ($B_2$) bonds. The high hardness of $WB_4$ may be attributed to the short boron dimer bonds and the three-dimensional framework of boron connecting the dimers to the boron hexagonal network in the a-b planes.
Figure 5:
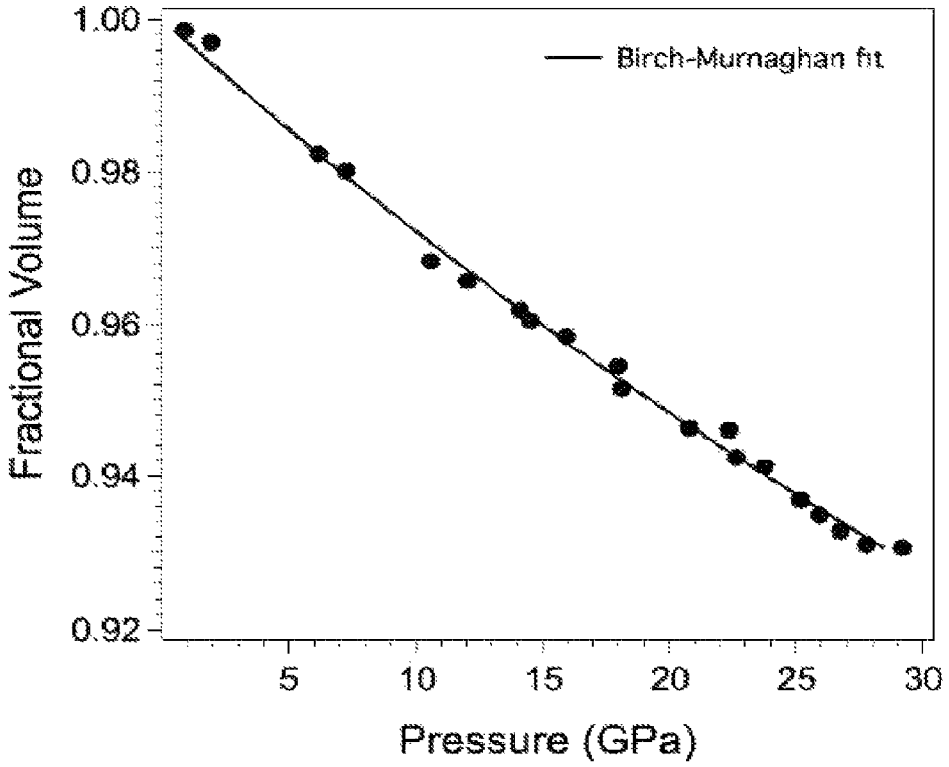
FIG. 5 shows fractional changes in volume ($V/V_0$) as a function of pressure for tungsten tetraboride. Fitting the data with a second-order Birch-Murnaghan equation of state (Eq. 5) results in a zero-pressure bulk modulus of 341 GPa.

Once phase pure $WB_4$ ingots were obtained by arc melting followed by cutting and polishing, Vickers micro-indentation hardness testing was carried out on optically-flat samples with the results depicted in FIG. 2. Hardness values of 43.3±2.9 GPa under an applied load of 0.49 N (low load) and 28.1±1.4 GPa under an applied load of 4.9 N (high load) were measured for pure tungsten tetraboride. While there are no theoretical or experimental data in the literature for medium loads (2.94, 1.96 and 0.98 N), the low-load hardness value of 43.3 GPa is very close to a theoretical prediction of 41.1-42.2 GPa (32) and both low-load and high-load hardness values are a bit lower than the experimental values of 46.2 GPa and 31.8 GPa, respectively, reported by Gu et al. (28). Moreover, the load-dependant hardness, commonly known as the indentation size effect (33) as seen in FIG. 2, has been observed with several other superhard materials as well (14, 16). This behavior has been attributed to the role of friction in indentation (34) and the recovery of the elastic component of deformation after unloading, which is prevalent in smaller indents, as well as the material's intrinsic response to different loads (35, 36). In addition, nanoindentation hardness values of 40.4±1.2 GPa (at a penetration depth of 250 nm) and 36.1±0.6 GPa (at a penetration depth of 1000 nm) were measured for $WB_4$ from the load-displacement curves, a typical one of which is presented in FIG. 3. The small pop-in events, observed in this Figure, may be due to a burst of dislocations, elastic-plastic deformation transitions or initiation and propagation of cracks (15). From this test, we estimate an elastic (Young's) modulus of 553±14 GPa for $WB_4$. The discrepancy between the hardness data obtained from microindentation and nanoindentation can be attributed to the differences in the geometry and shape of the indenters, depth of penetration of the indenters and hardness measurement methods (11). These high hardness values, regardless of the method of measurement, indicate that $WB_4$, within experimental errors, is similar in hardness to rhenium diboride, which possesses microindentation and nanoindentation hardness values of 48.0±5.6 GPa and 39.5±2.5 GPa, respectively (16, 19). This is very encouraging considering that tungsten is much less expensive than rhenium. Note also that the hardness of $WB_4$ is considerably higher than that of $OsB_2$ and $RuB_2$ (15) and at least 1.5 times that of the traditional material used for machine tools, tungsten carbide (37-39). The high hardness of $WB_4$ may be associated with its unique crystal structure consisting of a three-dimensional network of boron with tungsten atoms sitting in the voids (FIG. 4). The short bonds of the boron-boron dimers (1.698 Å) and their connections to the boron hexagonal planes above and below likely contribute to the high hardness of this material (28, 32). Since superhard materials usually possess a high bulk modulus, high pressure X-ray diffraction was used to measure the bulk modulus of $WB_4$, following the procedure explained in the Experimental Section along with Equations 5 and 6. The study of the incompressibility of this material under hydrostatic pressure resulted in a zero-pressure bulk modulus, $B_0$, of 341±2 GPa using a second order Birch-Murnaghan equation of state. If the third order Birch-Murnaghan equation is used, the resulting bulk modulus is 330±12 GPa with a first derivative ($B_0'$) of 5.1 (FIG. 5). These values are close to the predicted value (292.7-324.3 GPa) and about 11% higher than the bulk modulus of 304 GPa previously reported for this material (28, 32). The theoretical and experimental bulk modulus values both exceed 185-224 GPa for pure boron (40) and 308 GPa for pure tungsten (27).

Figure 6:
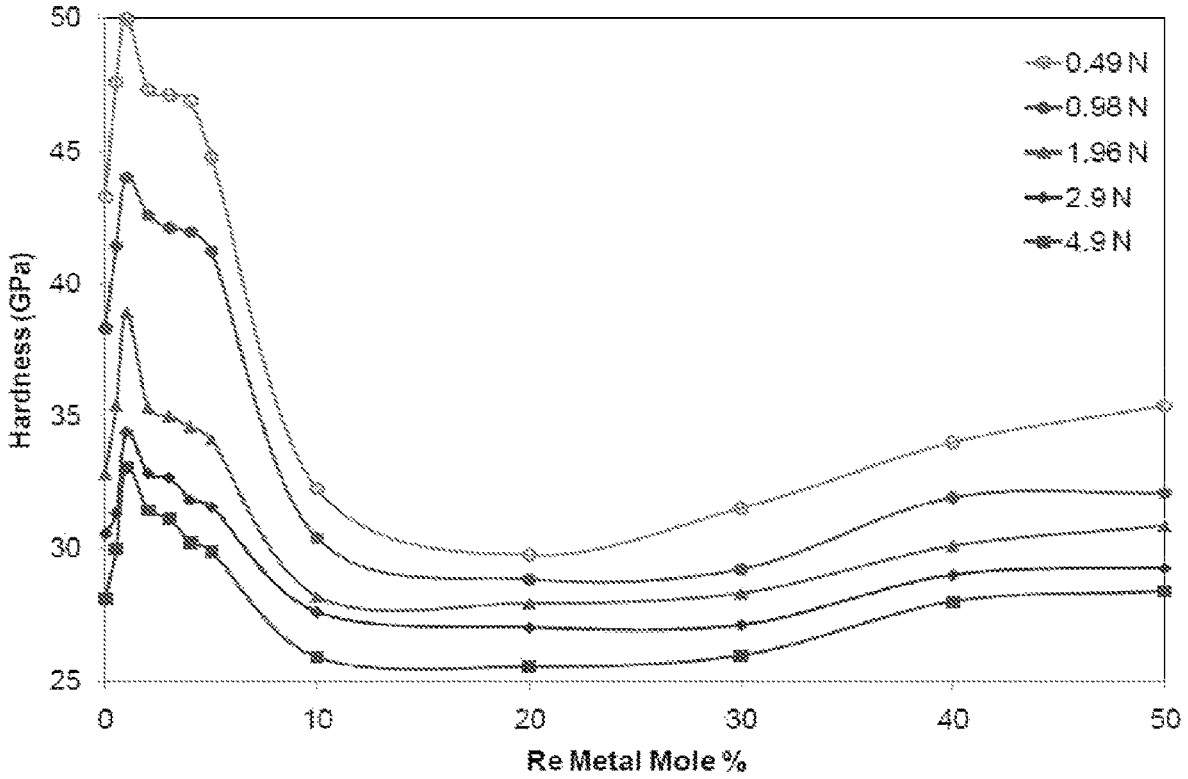
FIG. 6 shows micro-indentation hardness data for tungsten/rhenium boride samples as a function of rhenium content. Data were collected for samples with Re additions of 0.0, 0.5, 1.0, 2.0, 3.0, 4.0, 5.0, 10.0, 20.0, 30.0, 40.0 and 50.0 at. %. The low-load hardness increases from 43.3 GPa for $WB_4$ to a maximum of ~50 GPa at 1 at. % Re, decreases to a minimum of 29 GPa at 20 at. % Re and then increases again up to 34 at. % Re. Similar trends are observed for all of the loads (0.49 N-4.9 N).

Once the properties of $WB_4$ were well characterized, the possibility of increasing its hardness was investigated by adding rhenium to $WB_4$ in an attempt to make solid solutions. Compositions of the samples were confirmed with EDX. The micro-indentation hardness data for these compounds are plotted in FIG. 6. The hardness under low load (0.49 N) increases from 43.3 GPa for $WB_4$ to a maximum of 49.8 GPa for 1 at. % Re addition. It then decreases to about 29 GPa for 20 at. % Re and increases again to 34 GPa for 50 at. % Re. Similar trends are seen for loads of 0.98, 1.96, 2.9 and 4.9 N.

Figure 7:
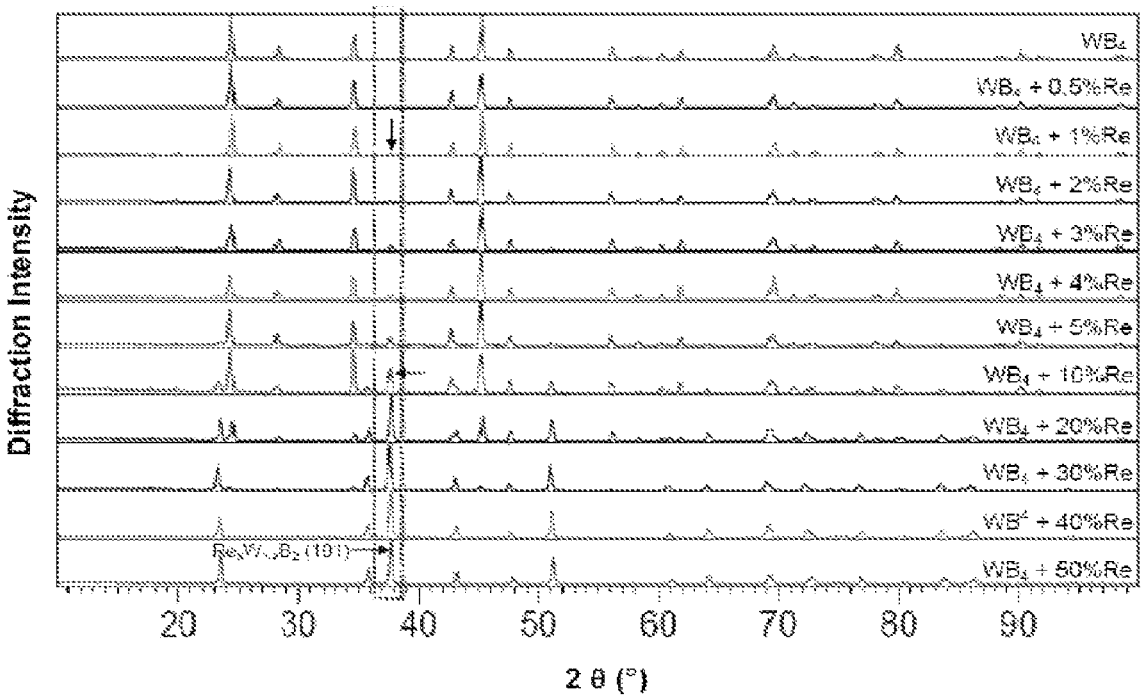
FIG. 7 shows X-ray diffraction patterns for tungsten tetraboride (top pattern) and various Re additions (0.5-50.0 at. %). The rectangle and arrows are to guide the eyes, showing the appearance of and drastic changes in the intensity of the major peak of the $Re_xW_{1-x}B_2$ solid solution phase (bottom pattern). These changes help to explain the changes in hardness observed in FIG. 6.

The XRD patterns for all these compounds are presented in FIG. 7 in order to follow the structural transitions. In this Figure, the top pattern belongs to $WB_4$ with no Re addition, while the bottom pattern with a W:Re ratio of 1:1 matches the $ReB_2$ pattern (JCPDS #00-011-0581). However, since the peaks of the pattern of this compound are shifted with respect to those of pure $ReB_2$, this material appears to be a solid solution of $ReB_2$ with W, i.e. $Re_{1-x}W_xB_2$. On the other hand, no shifts are observed in the peaks of $WB_4$ with the addition of Re, indicating that $W_xRe_{1-x}B_4$ solid solutions do not form under these synthetic conditions. By following the major peak of the $Re_{1-x}W_xB_2$ solid solution (the 101) from top to bottom, as highlighted inside the dotted rectangle, it is clear that this peak begins to appear at 0.5 at. % Re addition and increases substantially at 10 at. % Re.

Based on the rhenium-boron binary phase diagram, it appears that the $Re_{1-x}W_xB_2$ phase should precipitate from the melt first. If this is the case, it could serve as nucleation sites for $WB_4$ formation, resulting in $Re_{1-x}W_xB_2$ grains dispersed in a $WB_4$ majority phase. At low Re concentration, these $Re_{1-x}W_xB_2$ grains could prevent dislocations slip and make a harder material. This trend is indeed observed with the compound containing 1 at. % Re being the hardest (~50 GPa). The overall decrease in hardness at Re concentrations larger than 10 at. % can be attributed to the development of bulk $Re_{1-x}W_xB_2$ domains, leading to a decrease in the overall concentration of $WB_4$ and a large increase in the proportion of amorphous boron. The slight increase in hardness for 40 and 50 at. % Re may be attributed to a change in stoichiometry of the $Re_{1-x}W_xB_2$ phase toward a more Re-rich composition.

While the precise mechanism for the increased hardness by the addition of Re is not yet understood in detail, it is important to note that the measured nano-indentation hardness values for the compound of 1 at. % Re in $WB_4$ are 42.5±1.0 GPa and 37.3±0.4 GPa at penetration depths of 250 and 1000 nm, respectively, demonstrating that this material is harder than pure $WB_4$ (40.4 and 36.1 GPa) or $ReB_2$ (39.5 and 37.0 GPa) at the same penetration depths (16, 19). The elastic modulus of $WB_4$ containing 1 at. % Re is estimated to be 597±33 GPa using Equations 3 and 4. This value is higher than those of $RuB_2$ (366 GPa), $OsB_2$ (410 GPa) and $WB_4$ (553 GPa), but lower than the value of 712 GPa reported for $ReB_2$ (15).

Figure 8A:
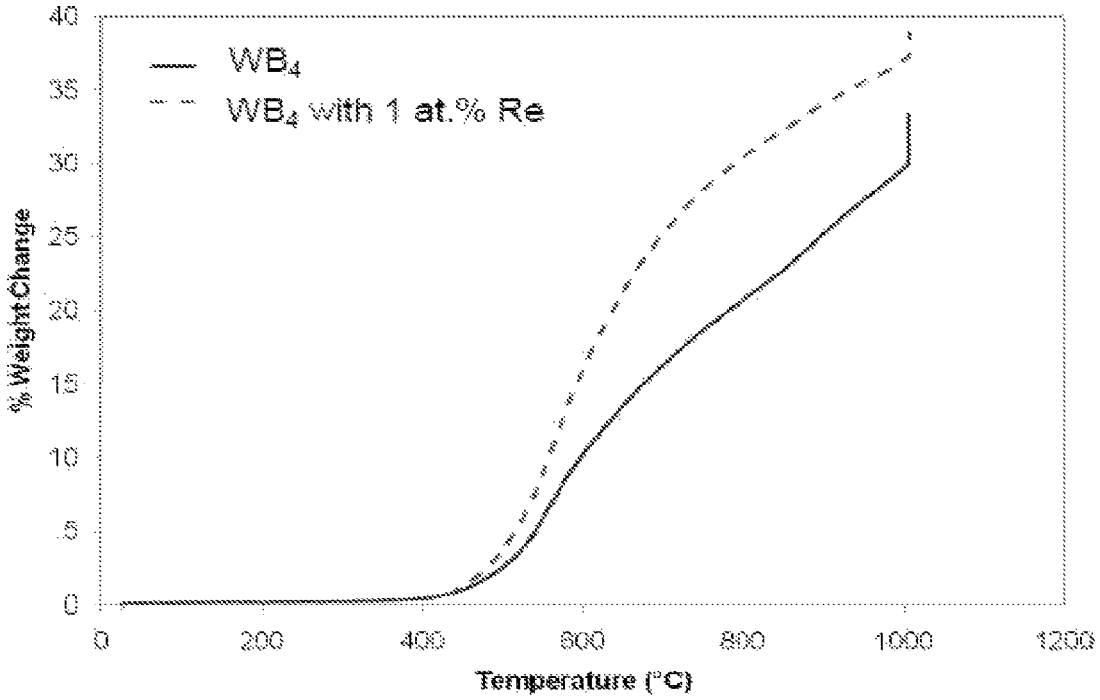
FIG. 8A shows thermal stability of tungsten tetraboride ($WB_4$) and $WB_4$+$Re_xW_{1-x}B_2$ (containing lat. % Re) as measured by thermal gravimetric analysis.
Figure 8B:
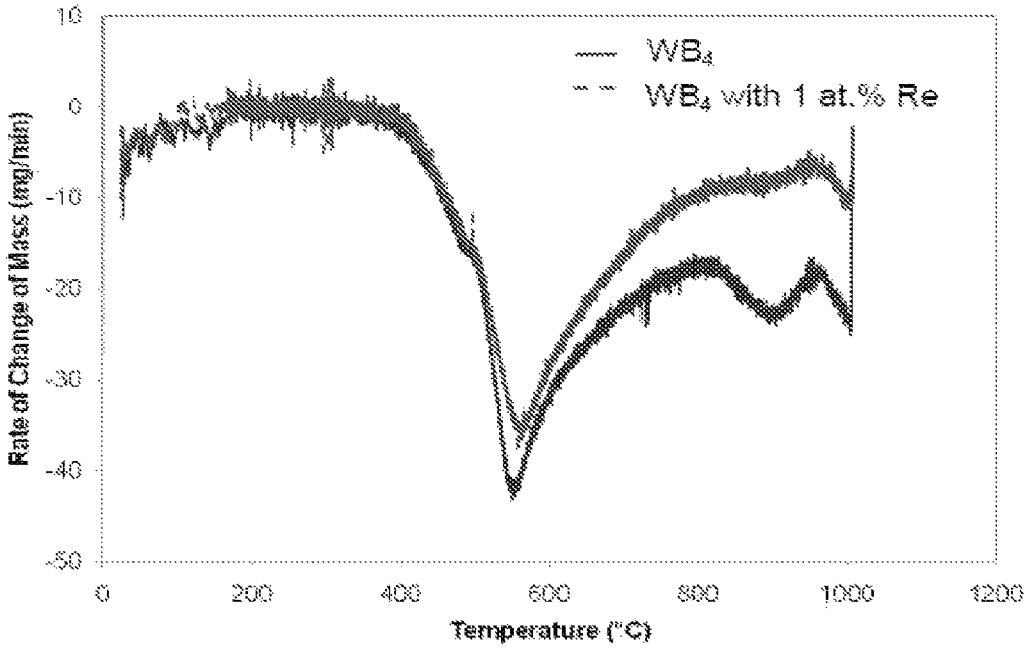
FIG. 8B shows DTG curves corresponding to FIG. 8A. These curves indicate that both materials are thermally stable up to 400° C. in air. The weight gain of about 30-40% for both samples above 400° C. can be mainly attributed to the oxidation of tungsten to $WO_3$.

In addition to mechanical properties, the thermal stability at high temperatures is important if these materials are to be considered for applications such as high-speed machining or cutting. Thermal stability curves on heating both tungsten tetraboride and tungsten tetraboride with 1 at. % Re are shown in FIG. 8. Both compounds are stable in air up to ~400° C. The weight gain above 400° C. in both compounds can be attributed to the formation of $WO_3$, as confirmed by powder X-ray diffraction.

In conclusion, tungsten tetraboride is an interesting material with a Vickers indentation hardness of 43.3±2.9 GPa, a bulk modulus of 341±2 GPa as measured by high pressure X-ray diffraction and a calculated Young's modulus of 553±14 GPa. The high hardness of tungsten tetraboride (43.3 GPa) categorizes this material among other superhard materials. The two benefits of this compound, facile synthesis at ambient pressure and relatively low cost elements, make it a potential candidate to replace other conventional hard and superhard materials in cutting and machining applications. By adding 1 at. % Re to $WB_4$, a hardness of ~50 GPa is reached. Powders of tungsten tetraboride with and without 1 at. % Re addition are thermally stable in air up to ~400° C. as measured by thermal gravimetric analysis. $WB_4$ and mixtures of $WB_4$ with $Re_xW_{1-x}B_2$, which contain only small amount of the secondary dispersed solid solution phase, may have potential for use in cutting, forming and drilling or wherever high hardness and wear resistance is a challenge.

Materials and Methods

Powders of pure tungsten (99.9994%, JMC Puratronic, USA) and amorphous boron (99+%, Strem Chemicals, USA) with a ratio of 1:12 were ground together using an agate mortar and pestle until a uniform mixture was achieved. The excess boron is needed to compensate for its evaporation during arcing and to ensure the thermodynamic stability of the $WB_4$ structure based on the binary phase diagram of the tungsten-boron system (24, 26). Furthermore, to test the possibility of increasing the hardness, rhenium (99.99%, CERAC Inc., USA) was substituted for tungsten at different concentrations of 0.5-50.0 at. %. Each mixture was pressed into a 350 mg pellet by means of a hydraulic (Carver) press under 10,000 lbs of force. The pellets were then placed in an arc melting furnace and an AC current of >70 Amps was applied under high-purity argon at ambient pressure. The synthesized ingots were cut in half using a diamond saw (South Bay Technology Inc., USA). One-half of the ingot was crushed to form a fine powder using a hardened-steel mortar. The powder was used for X-ray powder diffraction as well as high-pressure and thermal stability studies. The other half of the ingot was cold mounted in epoxy, using a resin/hardener set (Allied High Tech Products Inc., USA) and polished to an optically-flat surface for hardness testing. Polishing was performed with a tripod polisher (South Bay Technology Inc., USA) using polishing papers (120-1200 grits, Allied High Tech Products Inc., USA) followed by diamond films (30-0.5 microns, South Bay Technology Inc., USA).

The purity and composition of the samples were examined using X-ray powder diffraction (XRD) and energy-dispersive X-ray spectroscopy (EDX). Powder samples from crushing the ingots were tested for phase purity by employing an X'Pert Pro™ X-ray powder diffraction system (PANalytical, Netherlands). This test is critical as it determines the existence of other common low-hardness impurities, such as $WB_2$, in the synthesized samples. As X-ray diffraction only gives information about the phase purity of the sample and does not provide elemental analysis, energy dispersive X-ray spectroscopy (EDX) was used to check the composition of the synthesized materials. This was accomplished by scanning the flat, polished samples using an EDAX detector installed on a JEOL JSM 6700 F scanning electron microscope (SEM).

The mechanical properties of the samples were investigated using micro-indentation, nano-indentation and high pressure X-ray diffraction. To measure the Vickers micro-indentation hardness of the compounds, the optically-flat polished samples were indented using a MicroMet® 2103 micro-hardness tester (Buehler Ltd., USA) with a pyramid diamond tip. With a dwell time of 15 seconds, the indentation was carried out under 5 different loads ranging from 4.9 N (high load) to 0.49 N (low load). Under each load, the surface was indented at 15 randomly-chosen spots to ensure very accurate hardness measurements. The lengths of the diagonals of the indents were then measured with a high-resolution Zeiss Axiotech® 100HD optical microscope (Carl Zeiss Vision GmbH, Germany) and the following equation was used to obtain Vickers microindentation hardness values ($H_v$):

$$H_v=1854.4P/d^2 \quad (1)$$

where P is the applied load (in N) and d is the arithmetic mean of the diagonals of the indent (in micrometers).

Nano-indentation hardness testing was also performed on the polished samples by employing an MTS Nano Indenter XP instrument (MTS, USA) with a Berkovich diamond tip. After calibration of the indenter with a standard silica block, the samples were carefully indented at 20 randomly-chosen points. The indenter was set to indent the surface to a depth of 1000 nm and then retract. From the load-displacement curves for loading and unloading, both nano-indentation hardness of the material and an estimate of its Young's (elastic) modulus are achieved based on the method originally developed by Oliver and Pharr (41) using Equations 2 and 3:

$$H=P_{max}/A \quad (2)$$

where H, $P_{max}$ and A are nanoindentation hardness, peak indentation load and projected area of the hardness impression, respectively, and $$1/E_r=(1-V^2)/E+(1-v_i^2)/E_i \quad (3)$$

where E and v are the elastic modulus and Poisson's ratio of the material and $E_i$ and $v_i$ are the elastic modulus and Poisson's ratio of the indenter, respectively. The reduced modulus ($E_r$) can be calculated from the elastic stiffness (S), as follows:

$$S=dp/dh=(2/\sqrt{\pi})E_r\sqrt{A} \quad (4)$$

where p and h are load and depth of penetration, respectively, and dp/dh is the tangent to the unloading curve at the maximum (peak) load. Since the Poisson's ratio of $WB_4$ with and without Re is not yet known, an approximate value of 0.18 (calculated for $ReB_2$) was used to determine the Young's modulus (15). The reported modulus values are, therefore, estimates.

The compressibility of $WB_4$ was measured using high-pressure X-ray diffraction in a Diacell diamond anvil cell with neon gas as the pressure medium. Diffraction patterns were collected for the powder samples from ambient pressure to 30 GPa on Beamline 12.2.2 at the Advanced Light Source at Lawrence Berkeley National Laboratory (LBNL, USA). The data were fitted using either a second-order (Equation 5) or a third-order (Equation 6) Birch-Murnaghan equation of state to calculate both the zero-pressure bulk modulus ($B_0$) and its derivative with respect to pressure ($B_0'$).

$$P=(3/2)B_0[(V/V_0)^{-7/3}-(V/V_0)^{-5/3}] \quad (5)$$

$$P=(3/2)B_0[(V/V_0)^{-7/3}-(V/V_0)^{-5/3}]\times\{1-(3/4)(4-B_0')[(V/V_0)^{-2/3}-1]\} \quad (6)$$

Thermal stability of the powder samples was studied in air using a Pyris Diamond thermogravimetric/differential thermal analyzer module (TG-DTA, Perkin Elmer Instruments, USA). Samples were heated up to 200° C. at a rate of 20° C./min and soaked at this temperature for 10 minutes to remove water vapor. They were then heated up to a 1000° C. at a rate of 2° C./min and held at this temperature for 120 minutes. The samples were then air cooled at a rate of 5° C./min. X-ray diffraction was carried out on the powders after cooling to determine the resulting phases.

REFERENCES

1. Brookes C A (1970) Plastic deformation and anisotropy in hardness of diamond. *Nature* 228:660-661.
2. Sumiya H, Toda N, Satoh S (1997) Mechanical properties of synthetic type IIa diamond crystal. *Diam Relat Mater* 6:1841-1846.
3. Komanduri R, Shaw M C (1975) Wear of synthetic diamond when grinding ferrous metals. *Nature* 255:211-213.
4. Taniguchi T, Akaishi M, Yamaoka S (1996) Mechanical properties of polycrystalline translucent cubic boron nitride as characterized by the Vickers indentation method. *J Am Ceram Soc* 79:547-549.
5. Solozhenko V L, Andrault D, Fiquet G, Mezouar M, Rubie D C (2001) Synthesis of superhard cubic $BC_2N$. *Appl Phys Lett* 78:1385-1387.
6. Lee H C, Gurland J (1978) Hardness and deformation of cemented tungsten carbide. *Mater Sci Eng* 33:125-133.
7. Zerr A, Miehe G, Riedel R (2003) Synthesis of cubic zirconium and hafnium nitride having $Th_3P_4$ structure. *Nat Mater* 2:185-189.
8. Stone D S, Yoder K B, Sproul W D (1991) Hardness and elastic modulus of TiN based on continuous indentation technique and new correlation. *J Vac Sci Technol A* 9:2543-2547.
9. Wentorf R H (1957) *Cubic form of boron nitride. J Chem Phys* 26:956-956.
10. McMillan P F (2002) New materials from high-pressure experiments. *Nat Mater* 1:19-25.
11. Levine J B, Tolbert S H, Kaner R B (2009) Advancements in the search for superhard ultra-incompressible metal borides. *Adv Funct Mater* 19:3519-3533.
12. Kaner R B, Gilman J J, Tolbert S H (2005) Materials science-Designing superhard materials. *Science* 308: 1268-1269.
13. Cumberland R W, et al. (2005) Osmium diboride, an ultra-incompressible hard material. *J Am Chem Soc* 127: 7264-7265.
14. Chung H Y, Yang J M, Tolbert S H, Kaner R B (2008) Anisotropic mechanical properties of ultra-incompressible, hard osmium diboride. *J Mater Res* 23:1797-1801.
15. Chung H Y, Weinberger M B, Yang J M, Tolbert S H, Kaner R B (2008) Correlation between hardness and elastic moduli of the ultraincompressible transition metal diborides $RuB_2$, $OsB_2$, and $ReB_2$. *Appl Phys Lett* 92:261904 (3 pp).
16. Chung H Y, et al. (2007) Synthesis of ultra-incompressible superhard rhenium diboride at ambient pressure. *Science* 316:436-439.
17. Levine J B, et al. (2008) Preparation and properties of metallic, superhard rhenium diboride crystals. *J Am Chem Soc* 130:16953-16958.
18. Tkachev S N, et al. (2009) Shear modulus of polycrystalline rhenium diboride determined from surface Brillouin spectroscopy. *Adv Mater* 21:4284-4286.
19. Levine J B, et al. (2010) Full elastic tensor of a crystal of the superhard compound $ReB_2$. *Acta Mater* 58:1530-1535.
20. Suzuki Y, et al. (2010) Rhenium diboride's monocrystal elastic constants. *J AcoustSocAm* 127:2797-2801.
21. Simunek A (2009) Anisotropy of hardness from first principles: the cases of $ReB_2$ and $OsB_2$. *Phys Rev B* 80:060103 (4 pp).
22. Woods H P, Wawner F E, Fox B G (1966) Tungsten diboride: preparation and structure. *Science* 151:75-75.
23. Otani S, Ishizawa Y (1995) Preparation of $WB_{2-x}$ single crystals by the floating zone method. *J Cryst Growth* 154:81-84.

24. Romans P A, Krug M P (1966) Composition and crystallographic data for the highest boride of tungsten. *Acta Cryst* 20:313-315.
25. Bodrova L G, Kovalchenko M S, Serebryakova T I (1974) Theory, production technology, and properties of powders and fibers: preparation of tungsten tetraboride. *Powder Metall Met C*+13, 1-3.
26. Itoh H, Matsudaira T, Naka S, Hamamoto H, Obayashi M (1987) Formation process of tungsten borides by solid state reaction between tungsten and amorphous boron. *J Mater Sci* 22:2811-2815.
27. Brazhkin V V, Lyapin A G, Hemley R J (2002) Harder than diamond: dreams and reality. *Philos Mag* 82:231-253.
28. Gu Q, Krauss G, Steurer W (2008) Transition metal borides: superhard versus ultra-incompressible. Adv Mater 20:3620-3626.
29. Chung H Y, et al. (2007) Response to comment on synthesis of ultra-incompressible superhard rhenium diboride at ambient pressure. *Science* 318:1550d-1550d.
30. Dieter G E, *Mechanical Metallurgy,* 3rd Edition, 1986, McGraw Hill, New York, USA.
31. Weinberger M B, et al. (2009) Incompressibility and hardness of solid solution transition metal diborides: Os-xRuXB2. *Chem Mater* 21:1915-1921.
32. Wang M, Li Y W, Cui T, Ma Y M, Zou G T (2008) Origin of hardness in $WB_4$ and its implications for $ReB_4$, $TaB_4$, $MoB_4$, $TcB_4$, and $OsB_4$. *Appl Phys Lett* 93:101905 (3 pp).
33. Nix W D, Gao H J (1998) Indentation size effects in crystalline materials: a law for strain gradient plasticity. *J Mech Phys Solids* 46:411-425.
34. Li H, Ghosh A, Han Y H, Bradt R C (1993) The frictional component of the indentation size effect in low load microhardness testing. *J Mater Res* 8:1028-1032.
35. Bull S J, Page T F, Yoffe E H (1989) An explanation of the indentation size effect in ceramics. *Phil MagLett* 59:281-288.
36. Ren X J, Hooper R M, Griffiths C, Henshall J L (2003) Indentation size effect in ceramics: correlation with H/E. *J Mater Sci Lett* 22:1105-1106.
37. Lee H C, Gurland J (1978) Hardness and deformation of cemented tungsten carbide. *J Mater Sci Eng* 33:125-133.
38. Srivatsan T S, Woods R, Petraroli M, Sudarshan T S (2002) An investigation of the influence of powder particle size on microstructure and hardness of bulk samples of tungsten carbide. PowderMetall 122:54-60.
39. Zhao J F, Holland T, Unuvar C, Munir Z A (2009) Sparking plasma sintering of nanometric tungsten carbide. *Int J Refract Met H* 27:130-139.
40. Nelmes R J, et al. (1993) Neutron-diffraction and x-ray-diffraction measurements of the bulk modulus of boron. *Phys Rev B* 47:7668-7673.
41. Oliver W C, Pharr G M (1992) An improved technique for determining hardness and elastic modulus using load and displacement sensing indentation experiments. *J Mater Res* 7:1564-1583.

The embodiments illustrated and discussed in this specification are intended only to teach those skilled in the art how to make and use the invention. In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A composition comprising a compound of a formula W1-xMxBy and a second metal element, wherein:

W is tungsten;

B is boron;

M comprises at least one element selected from the group of elements consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), osmium (Os), iridium (Ir), Rhenium (Re), lithium (Li), and aluminum (Al);

x is from about 0.001 to about 0.999;

y is about 4.0;

the second metal element is Co, Ni, Cu, or any combination thereof; and

W1-xMxBy is a crystalline solid characterized by at least one X-ray diffraction pattern reflection at 2 theta=24.2±0.2.

2. The composition according to claim 1, wherein M comprises Ti, V, Cr, Mn, Fe, Co, Ni, Cu, Zn, Zr, Nb, Mo, Ru, Hf, Ta, Os, Ir, Re, or any combination thereof.

3. The composition according to claim 1, wherein M comprises Ti, V, Cr, Mn, Fe, Zn, Zr, Nb, Mo, Ru, Hf, Ta, Os, Ir, Re, or any combination thereof.

4. The composition according to claim 1, wherein M comprises Ti, V, Cr, Mn, Zr, Nb, Mo, Hf, Ta, Re, or any combination thereof.

5. The composition according to claim 1, wherein M comprises V, Cr, Mn, Nb, Mo, Ta, Re, or any combination thereof.

6. The composition according to claim 1, wherein M comprises Nb, Ta, Mo, Re, or any combination thereof.

7. The composition according to claim 1, wherein M comprises Ta, Mn, Cr, or any combination thereof.

8. The composition according to claim 1, wherein M comprises V and x is from about 0.001 to about 0.3.

9. The composition according to claim 1, wherein M comprises Mo and x is from about 0.001 to about 0.05.

10. The composition according to claim 1, wherein M comprises Cr and x is from about 0.01 to about 0.15.

11. The composition according to claim 1, wherein x is from about 0.001 to about 0.6.

12. The composition according to claim 1, wherein x is from about 0.001 to about 0.4.

13. The composition according to claim 1, wherein x is from about 0.01 to about 0.3.

14. The composition according to claim 1, wherein x is from about 0.01 to about 0.1.

15. The composition according to claim 1, wherein x is from about 0.001 to about 0.01.

16. The composition according to claim 1, wherein the composition comprises a crystalline solid characterized by at least one X-ray diffraction pattern reflection at 2 theta=34.5±0.2 or 45.1±0.2.

17. The composition according to claim 1, wherein the composition comprises a crystalline solid characterized by at least one X-ray diffraction pattern reflection at 2 theta=28.1±0.2, 42.5±0.2, or 55.9±0.2.

18. The composition according to claim 1, wherein the composition comprises a crystalline solid characterized by at least one X-ray diffraction pattern reflection at 2 theta=47.5±0.2, 61.8±0.2, 69.2±0.2, 69.4±0.2, 79.7±0.2, 89.9±0.2, or 110.2±0.2.

19. The composition according to claim 1, wherein the composition comprises a crystalline solid characterized by at least two X-ray diffraction pattern reflections at 2 theta=28.1±0.2, 34.5±0.2, 42.5±0.2, 45.1±0.2, 47.5±0.2, 55.9±0.2, 61.8±0.2, 69.2±0.2,69.4±0.2, 79.7±0.2, 89.9±0.2, or 110.2±0.2.

20. The composition according to claim 1, wherein the composition comprises a crystalline solid characterized by at least five X-ray diffraction pattern reflections at 2 theta=28.1±0.2, 34.5±0.2, 42.5±0.2, 45.1±0.2, 47.5±0.2, 55.9=0.2, 61.8=0.2, 69.2=0.2, 69.4±0.2, 79.7±0.2, 89.9±0.2, or 110.2±0.2.

* * * * *